US005967318A

United States Patent [19]

Rosler

[11] Patent Number: 5,967,318

[45] Date of Patent: Oct. 19, 1999

[54] DEVICE FOR PACKAGING EXTENDED ARTICLES

[76] Inventor: Peter Rosler, P. Rösler Jfemueg 3, 88239 Wangen, Germany

[21] Appl. No.: 09/116,529

[22] Filed: Jul. 16, 1998

[30] Foreign Application Priority Data

Jul. 17, 1997 [DE] Germany ..... 197 30 696

[51] Int. Cl.[6] ..... B65D 85/20

[52] U.S. Cl. ..... 206/372; 206/379; 206/443

[58] Field of Search ..... 206/349, 372–379, 206/443; 211/70.6

[56] References Cited

U.S. PATENT DOCUMENTS

| | | | |
|---|---|---|---|
| 4,598,822 | 7/1986 | Hemmings | 206/379 |
| 5,148,914 | 9/1992 | Budert et al. | 206/379 |
| 5,562,212 | 10/1996 | Rosler | 206/379 |
| 5,775,499 | 7/1998 | Budert | 206/379 |
| 5,829,596 | 11/1998 | Budert | 206/379 |

*Primary Examiner*—Paul T. Sewell
*Assistant Examiner*—Luan K. Bui
*Attorney, Agent, or Firm*—Frederick L. Tolhurst

[57] ABSTRACT

Apparatus for packaging and organizing elongated articles such as tools wherein a body (3) is receivable in a sheathing (2). Body (3) has a bottom mounting surface (4) with a longitudinal extension, a support element (5) parallel thereto, and a mounting surface that is vertical to these members and that holds them spaced apart from one another. The support element has boreholes (6) aligned in a line. A longitudinal wall (8) between mounting surface (4) and support element (5) is provided with projections (9) that extend into the free space between mounting surface (4) and support element (5). Projections (9) narrow the originally designed diameters of the boreholes in the free space, so that as a result of these projections, a clamping effect is exerted on articles (1) mounted standing upright on mounting surface (4).

12 Claims, 2 Drawing Sheets

DEVICE FOR PACKAGING EXTENDED ARTICLES

BACKGROUND OF THE INVENTION

1. Field of the Invention

The invention relates to containers for receiving and holding elongated articles, such as a package for elongated articles, especially articles having a small diameter, as well as for conveniently organizing such articles for use.

2. Description of the Prior Art

In the prior art, containers are known wherein a body that is at least partially held in a sheathing incorporates a closed bottom bearing surface having a certain longitudinal extension or dimension and also having a vertical spacing or dimension. Such container bodies have also included a similarly dimensioned longitudinal support element that is parallel to the base and have had a plurality of boreholes arranged in at least one line to receive and hold articles.

In prior art containers with bodies of this type, the body that includes the bottom bearing surface includes two articulated cover halves that, when joined together, form a closed container for the articles. In such containers, a border is mounted on the interior surface of each cover half, parallel to the line of boreholes. Each border includes cutouts that are semi-circular in shape and that are aligned with the boreholes. When the cover halves are closed, the cutouts surround the articles and secure their position as, for example, during transport. When the cover halves are opened, the articles are displayed ready for use.

Such known devices or containers are costly to manufacture due to the articulated cover halves and the corresponding and identical holding strips therein, associated with one another for holding the articles. Another disadvantage has been that, at times when it is opened, the container requires considerable space. Furthermore, the container design is not adapted to automated packaging procedures wherein the articles are to be received and held therein. Also, when the container is closed, the articles are not adequately secured against axial movement, which, particularly in the case of sensitive articles, such as small or fragile and costly articles (borers, drill bits, milling cutters or tools and so forth with or without diamond fittings, for example for precision engineering, dental technology, ICE manufacture or the like), can lead to exceptional damages and costs.

Accordingly, there was a need in the prior art for improved apparatus for elongated article packaging that could also conveniently organize such articles for ready use, such that the articles are secured against undesired movements. Preferably, the container would require comparably little space even during use. Most preferably, the container would also be suitable for use in automated packaging procedures.

SUMMARY OF THE INVENTION

In accordance with the subject invention, projections extend into the free space defined between a bottom support surface and a support element that is provided with boreholes. Such projections cause a slight narrowing in the borehole diameter, but are somewhat elastically deformable to provide clamping pressure on the bottom end or the shaft end of an elongated article or tool, so that the article is held securely in its associated borehole. That is, such projections invade or intrude into the space defined by longitudinally extending the contour of the borehole perimeter or the borehole cross-section through the free space defined between the bottom support surface and the support elements. The projections deform to accept an article in the space defined by such longitudinal extension and urge the article against the side of the borehole.

The support element, which, dependent upon the number of receiving boreholes, can have any desired lengthwise extension, has a transverse dimension sufficient to provide adequate structural strength to the wall surrounding the relevant borehole. In this way, the required space or dimension transverse to the line of boreholes is sufficiently small to make the apparatus suitable for automated packaging procedures, since the articles can be introduced into the boreholes in alignment with their longitudinal axes—advantageously in vertical alignment.

Other objects and advantages of the subject invention will become apparent to those particularly skilled in the art as a description of the presently preferred embodiments thereof proceeds.

BRIEF DESCRIPTION OF THE DRAWINGS

The preferred embodiments of the presently disclosed invention are shown and described in connection with the accompanying drawings wherein.

DESCRIPTION OF A PRESENTLY PREFERRED EMBODIMENT

Figure 1:
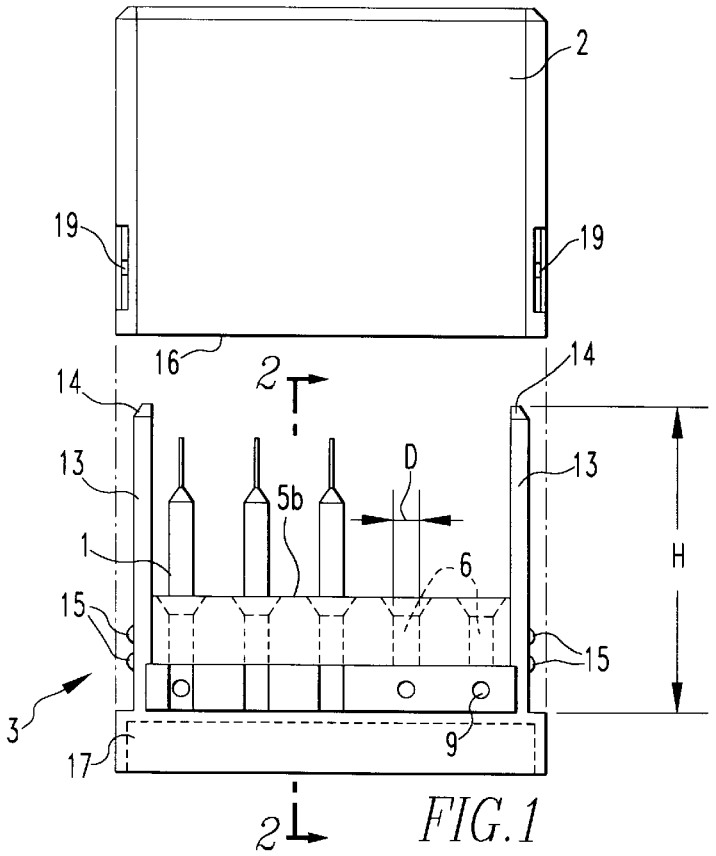
FIG. 1 is a view of an arrangement according to the invention with sheathing separated from the body receiving and holding the articles.

Positional references in the following description, such as "top," "bottom," "to the rear" and so forth, indicate relative positions only on the representations shown in the drawings, serving solely for simplification of the description and are not to be seen as limiting in any way.

The arrangement for receiving and holding elongated articles 1 having relatively small diameters in relation to their lengths, which articles can be round, rectangular, quadratic or of any shape, comprises a sheathing 2 in which a body 3 can be at least partially received and held. Body 3 includes a closed bottom bearing surface 4 having a given lengthwise or transverse extension and a support element 5 having substantially the same lengthwise or transverse extension. Support element 5 has a bottom surface 5*a* that is located at a given vertical spacing above bearing surface 4. Support element 5 is oriented such that bottom surface 5*a* is substantially parallel to bearing surface 4 and has a plurality of boreholes 6 that are aligned on respective axes 6*a*. Boreholes 6 are arranged in at least one line in a direction that is transverse to axes 6*a* with boreholes 6 to receive and hold articles 1. Between bearing surface 4 and the bottom surface 5*a* of support element 5 is a free space 7, closed off on its rear side by a rear wall 8.

The axes 6*a* of boreholes 6 are aligned substantially parallel to and in the direction of the longitudinal extension of support element 5, whereby the diameters or transverse sections of the individual boreholes can differ from one another within a certain limited range.

Elastically deformable projections 9 (FIGS. 1 to 4) or 10 (FIGS. 5 to 7) are connected to rear wall 8, and from that position they narrow down by a predetermined dimension the original actual diameters of boreholes 6 projecting into free space 7 between support element 5 and bearing surface 4. That is, projections 9 or 10 extend from rear wall 8 into free space 7 and, furthermore, extend into the space or volume defined by the cross-section of borehole 6 as extended in the longitudinal direction of axes 6*a* through free space 7 to bearing surface 4.

Figure 4A:
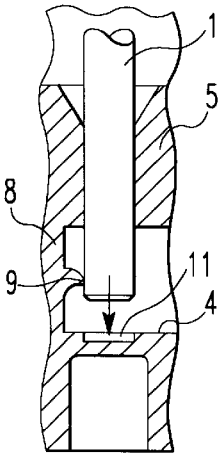
FIG. 4 is an enlarged partial view of three sections (a), (b) and (c) that are taken along line 2—2 of FIG. 1 and showing alternative embodiments.
Figure 4B:
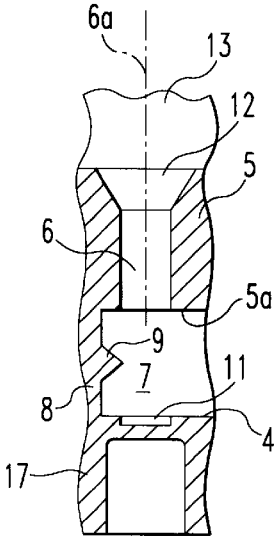
Figure 4C:
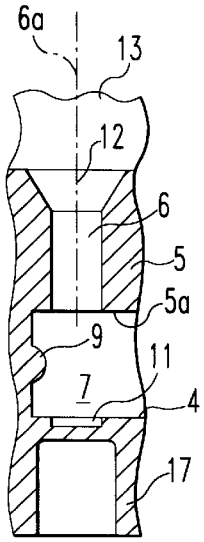

Projections 9, as shown in FIGS. 1 to 4, can have various shapes such as conical plugs or spherical caps, and lie substantially in a plane that is oriented substantially at a right angle to rear wall 8 and perpendicular to the axes 6*a* of boreholes 6. As shown in FIG. 4(*a*), upon introduction of an article 1 into borehole 6 having free space 7 located thereunder, a projection 9, which projects into the transverse section of the longitudinal extension of borehole 6 through free space 7, is elastically deformed. Article 1 is thus held securely by a certain clamping effect resulting from projection 9 urging article 1 against the cylindrical surface defined by borehole 6. This secure hold can be still further strengthened by the provision of shallow depressions 11 in bottom of bearing surface 4. Depressions 11 are respectively aligned concentrically to the axes 6*a* of boreholes 6 and with substantially the same transverse section as the respective borehole.

Figure 5:
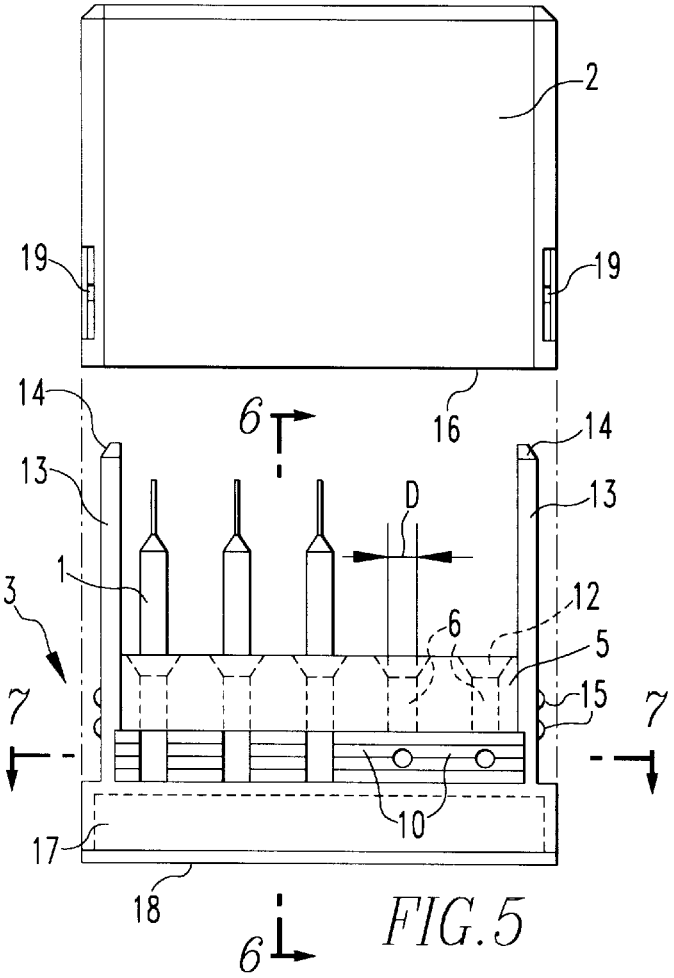
FIG. 5 is a view of another alternative embodiment of the container shown in FIG. 1.
Figure 6:
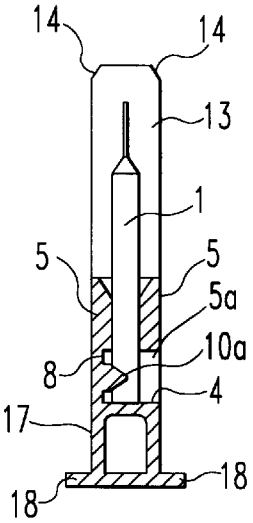
FIG. 6 is a cross section taken along line 6—6 of FIG. 5.
Figure 7:
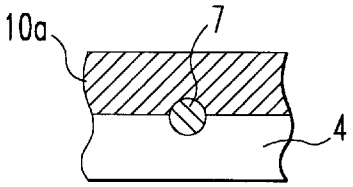
FIG. 7 is a partial cross section taken along line 7—7 of FIG. 5.

Alternatively, as shown in FIGS. 5 to 7, projections 10 can be configured as horizontal, overhanging projections 10*a* between individual boreholes 6, whereby in the area of the boreholes these projections 10*a* are instead hollowed out in such a manner as to form a small channel, whereby at least one end of projection 10, on the side adjacent channel, projects into the actual transverse section projecting into free space 7 to generate a clamping effect relative to article 1. That is, projection 10*a* extends into the space defined by projecting the cross-section of borehole 6 longitudinally in the direction of axes 6*a* and through space 7. Preferably however both ends project from projections 10*a* adjacent to the channel, so that, as shown in FIG. 7, they surround article 1 in such a manner that the edges of the overhanging projections—seen from the perspective of rear wall 8—lie on that side of the plane including the axes of articles 1, parallel to rear wall 8. Also with this embodiment, in the same manner as illustrated in FIGS. 1–4, depressions 11 can be provided in bearing surface 4 so that the clamping and secure holding is enhanced.

Figure 2:
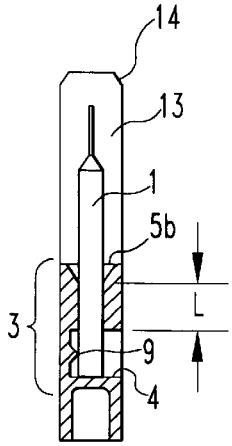
FIG. 2 is a cross section of FIG. 1 taken along line II—II.
Figure 3:
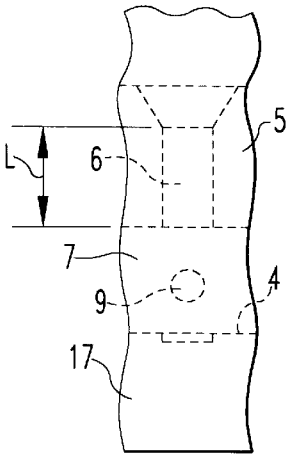
FIG. 3 is an enlarged partial view of the body shown in FIG. 1.

As shown in FIG. 2, the longitudinal dimension or length L of boreholes 6 in support element 5 is preferably designed so that it is at least double the diameter D (FIG. 1) of the boreholes. Secure holding of articles 1 is thus attained in connection with the clamping effect obtained by elastically deformable projections 9 and 10, because the articles then are surrounded and held relatively tightly along a sufficiently long area by the borehole wall. This design offers the advantage that, within certain limits, various tolerances are allowable for boreholes 6. Thus, not every borehole 6 must be adapted precisely to the transverse section of the article 1 to be held. This is advantageous in that, in addition to simplifying the manufacture of the disclosed apparatus, it also facilitates the introduction and removal of an article into and out of the apparatus.

Preferably, above the standard borehole 6 in support element 5, a funnel-like cutout 12 is provided. Cutout 12 tapers into borehole 6. This is particularly advantageous in applications involving automated insertion of article 1.

Also preferably, the respective, longitudinal sides of support element 5 and bottom bearing surface 4 that are adjacent are each connected to a vertically upright wall member 13 that extends beyond and above the top surface 5*b* of support element 5. Wall member 13 extends to a height H, such that it extends above the top end of article 1 as article 1 is vertically supported on bearing surface 4. Wall members 13 have substantially the same width as support element 5. Wall members 13 protect the extremely expensive and sensitive articles (tools) and also guide sheathing 2 during the introduction and removal of body 3. Preferably, the vertically upright wall members 13 include at their top ends outwardly oriented (to the side as well as to the front and rear) oblique surfaces 14 that are angled to guide sheathing 2. Furthermore these wall members 13 are provided with outwardly (sideways) projecting knobs 15 at the level of or laterally adjacent to support element 5. Knobs 15 are arranged one over the other and cooperate with other knobs 19 that are located on the bottom interior surface of sheathing 2 that opposes wall member 13. Knobs 19 are located such that at times when base 3 is assembled with sheathing 2, knobs 19 on the interior surface of sheathing 2 oppose knobs 15 on wall member 13, providing a detent or catch engagement to hold sheathing 2 together with body 3.

Bottom bearing surface 4 preferably is of such dimensions that when the bottom opening border 16 of sheathing 2 overlaps stationary wall members 13 and support element 5, sheathing 2 contacts bearing surface 4 around the entire periphery of opening border 16.

Bottom bearing surface 4 forms the top surface or top closing surface of a quadratic body 17, which can incorporate a hollow space or can be configured as a solid body, whereby foot strips 18 (FIGS. 5 and 6) can project outward from the stationary, longitudinally running bottom surface, to provide increased stationary stability for the entire apparatus.

Although the invention has been limited in its description with reference to specific embodiments and examples which were selected for explanatory purposes, it is nonetheless clear that numerous modifications could be undertaken by the expert in the art with knowledge of the teachings relating to the object of the invention, without exceeding the scope of the invention.

I claim:

1. A container for elongated articles wherein said container includes a body that can be received and held at least partially in a sheathing, said body having a closed bottom bearing surface with a given elongated extension and also having an elongated support element that is substantially parallel to and vertically spaced apart from said bottom bearing surface, said support element having a plurality of boreholes arranged in at least one line to receive and hold the articles, said body comprising:

a wall that connects the bottom bearing surface and the support element, said wall being aligned substantially parallel to the line of the boreholes, said wall maintaining a free space between said support element and said bottom bearing surface; and elastically deformable projections that are connected to said wall, said projections extending into the free space between the bottom bearing surface and the elongated support element so as to slightly narrow the transverse sections of the area defined by extending the cross-section of the boreholes through the free space between the support element and the bottom bearing surface.

2. The container of claim 1 wherein said projections are located on said wall such that said projections lie substantially in a plane that is oriented substantially at a right angle with respect to the wall and perpendicular to the axes of the boreholes.

3. The container of claim 2, wherein said projections are substantially in the shape of conical plugs.

4. The container of claim 2, wherein said projections are substantially in the shape of spherical caps.

5. The container of claim 1, wherein said projections are substantially in the shape of separate, horizontal and overhanging projections between the individual boreholes, said projections having at least one end that faces the boreholes and that extends into the volume defined by extending the transverse sections of the boreholes through the space between the bottom bearing surface and the elongated support element.

6. The container of claim 1, wherein said bottom bearing surface further includes depressions at locations that oppose the boreholes, each of said depressions having substantially the same transverse section as the respective borehole.

7. The container of the claim 1 wherein the length of the borehole in the support element is at least twice the borehole diameter.

8. The container of claim 1, wherein the end of the borehole in the support element that is located oppositely from the bearing surface has a funnel-like cutout taper.

9. The container of claim 1, wherein the bottom bearing surface and the support element are connected on their longitudinally aligned, front ends by a stationary wall member that extends beyond the top surface of the support element to a predetermined length that is longer than the distal portion of an article that is located in a borehole and that contacts the bottom bearing surface.

10. The container of claim 9, wherein the top surface of the stationary wall member is an outwardly and downwardly directed oblique surface and wherein wall members include first knobs that are located on the outside surfaces of the wall members and in the area of the support member, said knobs being aligned one over the other, said knobs cooperating with second knobs that are located in an area on the interior surface of the sheathing that is adjacent to the opening border of the sheathing, said first and second knobs cooperating to form a catch engagement.

11. The container of claim 9, wherein the bottom bearing surface comprises the top surface of a quadratic body and also forms the mounting surface for the opening border of the sheathing at times when the sheathing overlaps the stationary wall members.

12. The container of claim 11, wherein the quadratic body is provided with foot strips directed outward from the stationary, longitudinally running surface.

* * * * *